United States Patent [19]

Barrett et al.

[11] 4,305,541

[45] Dec. 15, 1981

[54] ELECTRONICALLY OPERATED PORTABLE NAIL GUN

[75] Inventors: Edward E. Barrett, Massapequa Park; Dusan Dubovsky, Roslyn Heights; Steven Hahn, East Hampton; Albert Lensky, Fresh Meadow; Morris Pinczewski, New York, all of N.Y.

[73] Assignee: Swingline Inc., Long Island, N.Y.

[21] Appl. No.: 80,308

[22] Filed: Oct. 1, 1979

[51] Int. Cl.[3] ..... B25C 1/06

[52] U.S. Cl. ..... 227/120; 227/131; 227/114

[58] Field of Search ..... 173/117; 227/120, 131, 227/123, 127, 128, 114, 115, 116, 109

[56] References Cited

U.S. PATENT DOCUMENTS

| | | | |
|---|---|---|---|
| 3,087,162 | 4/1963 | Saurenman et al. | 227/127 |
| 3,179,866 | 4/1965 | Doyle et al. | 318/125 |
| 3,215,864 | 11/1965 | Doyle et al. | 307/88.5 |
| 3,267,337 | 8/1966 | Doyle et al. | 317/148.5 |
| 3,281,046 | 10/1966 | Boulay | 227/121 |
| 3,347,439 | 10/1967 | Doherty | 227/128 |
| 3,552,627 | 1/1971 | Moreno | 227/121 |
| 3,589,587 | 6/1971 | Manganaro | 227/131 |
| 3,633,811 | 1/1972 | Ploen | 227/120 X |
| 3,720,364 | 3/1973 | Maestri | 227/109 |
| 3,786,978 | 1/1974 | Manganaro | 227/131 |
| 3,893,610 | 7/1975 | Smith | 227/116 |
| 3,971,969 | 7/1976 | Wines et al. | 310/30 |
| 4,005,812 | 2/1977 | Doyle et al. | 227/131 |
| 4,033,500 | 7/1977 | Manganaro | 227/131 |
| 4,183,453 | 1/1980 | Barrett et al. | 227/131 |
| 4,184,620 | 1/1980 | Ewig | 227/128 |

OTHER PUBLICATIONS

General Electric SCR Manual, Fifth Ed., pp. 202-203, 1972.

*Primary Examiner*—Paul A. Bell
*Attorney, Agent, or Firm*—Pennie & Edmonds

[57] ABSTRACT

An electronically operated portable nail driving gun is disclosed. Nails are driven into a workpiece by a driver blade which is actuated by a solenoid powered by a source of alternating current. Each actuation of the device produces two successive driving strokes delivered to a nail. The tool is also provideed with means for preventing more than one nail being driven during each actuation of the tool. A preferred embodiment in which the tool is double insulated is also disclosed as are control circuits which permit operation at either 110 V. or 220 V.

12 Claims, 13 Drawing Figures

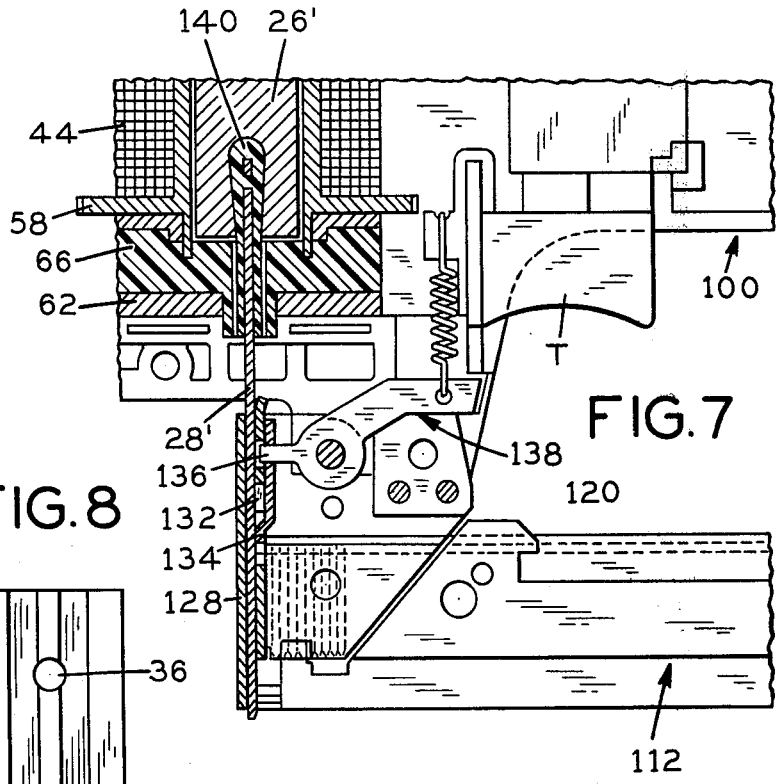
FIG.7
FIG.8
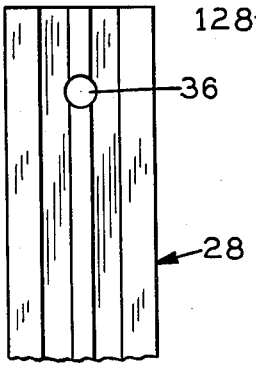
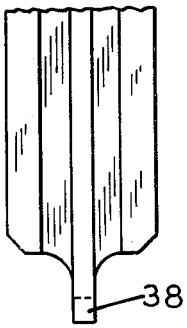
FIG.9
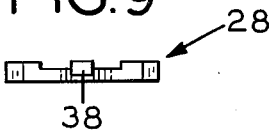
FIG.10
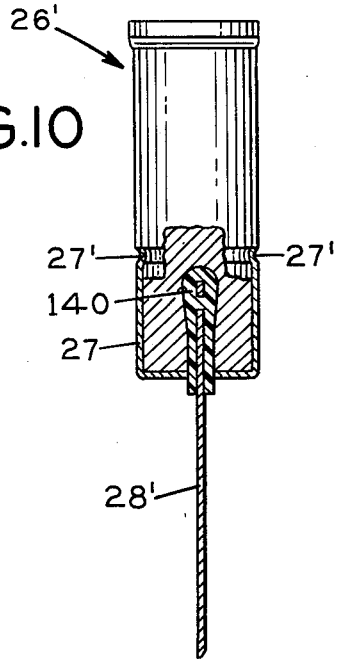
FIG.11
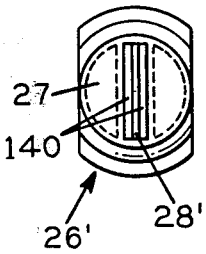

A.C.
A.C.
D3
R7
Q3
C4
C3

A.C.
A.C.
12A
12A
D3
R7
Q3
C4
C3
R8
Q2
C2
D2
R6
Q1
R5
FUSE
COIL
SCR
R2
C5
R4
D1
R9
R3
SW
B
A
C1
R1

ELECTRONICALLY OPERATED PORTABLE NAIL GUN

BACKGROUND OF THE INVENTION

This invention relates to electronically operated portable nail guns and, more particularly, to devices of this type which are provided with electronic control circuitry for supplying multiple unidirectional electronic impulses to a solenoid which powers the driving blade of the device. This results in the delivery of a like number of driving strokes to a single nail for each actuation of the tool. Means are also provided for preventing the advancement of more than one nail into the path of the driver blade during the driving strokes produced in a single actuation of the device.

An electronically operated fastener driving tool is disclosed in application Ser. No. 880,846, filed Feb. 23, 1978 now U.S. Pat. No. 4,183,453 and assigned to the assignee of this application. The cited application includes circuitry comprising only diodes, resistors, capacitors and a single SCR to provide a predetermined plurality of unidirectional current pulses to the solenoid during consecutive like-poled half-cycles of alternating current so that the driver blade will deliver a predetermined plurality of driving strokes, preferably two, for a single actuation of the tool. In the cited application there is also disclosed alternative mechanical means responsive to the activating mechanism of the tool, to prevent more than one fastener in a strip of fasteners from being advanced into the path of the driver blade during a single actuation of the tool.

SUMMARY OF THE INVENTION

This invention relates to a two-stroke portable electronic nail gun having an electronic trigger control circuit mounted therein for producing two driving strokes to a nail and means for preventing the advancement of a second nail into the driving path while a first nail is being driven. The invention is disclosed in both a single and a double insulated mode.

BRIEF DESCRIPTION OF THE DRAWINGS

FIG. 2 is a vertical section taken along line 2—2 of FIG. 1 showing a molded construction about the conductors leading to the terminal.

FIG. 3 is a vertical section similar to FIG. 2 in which the conductors leading to the terminal are individually insulated.

FIG. 7 is an enlarged detail of a modification of a portion of FIG. 1 illustrating an insulated driver blade assembly.

FIG. 8 is a front view of the driver blade.

FIG. 9 is an underside plan view of the driver blade of FIG. 8.

FIG. 10 is an end view partly in section of the driver blade and plunger showing the connection according to the embodiment illustrated in FIG. 7.

FIG. 11 is an underside plan view of the driver blade shown in FIG. 10.

DETAILED DESCRIPTION OF THE PREFERRED EMBODIMENT

I. Preferred Mechanical Embodiment

Figure 1:
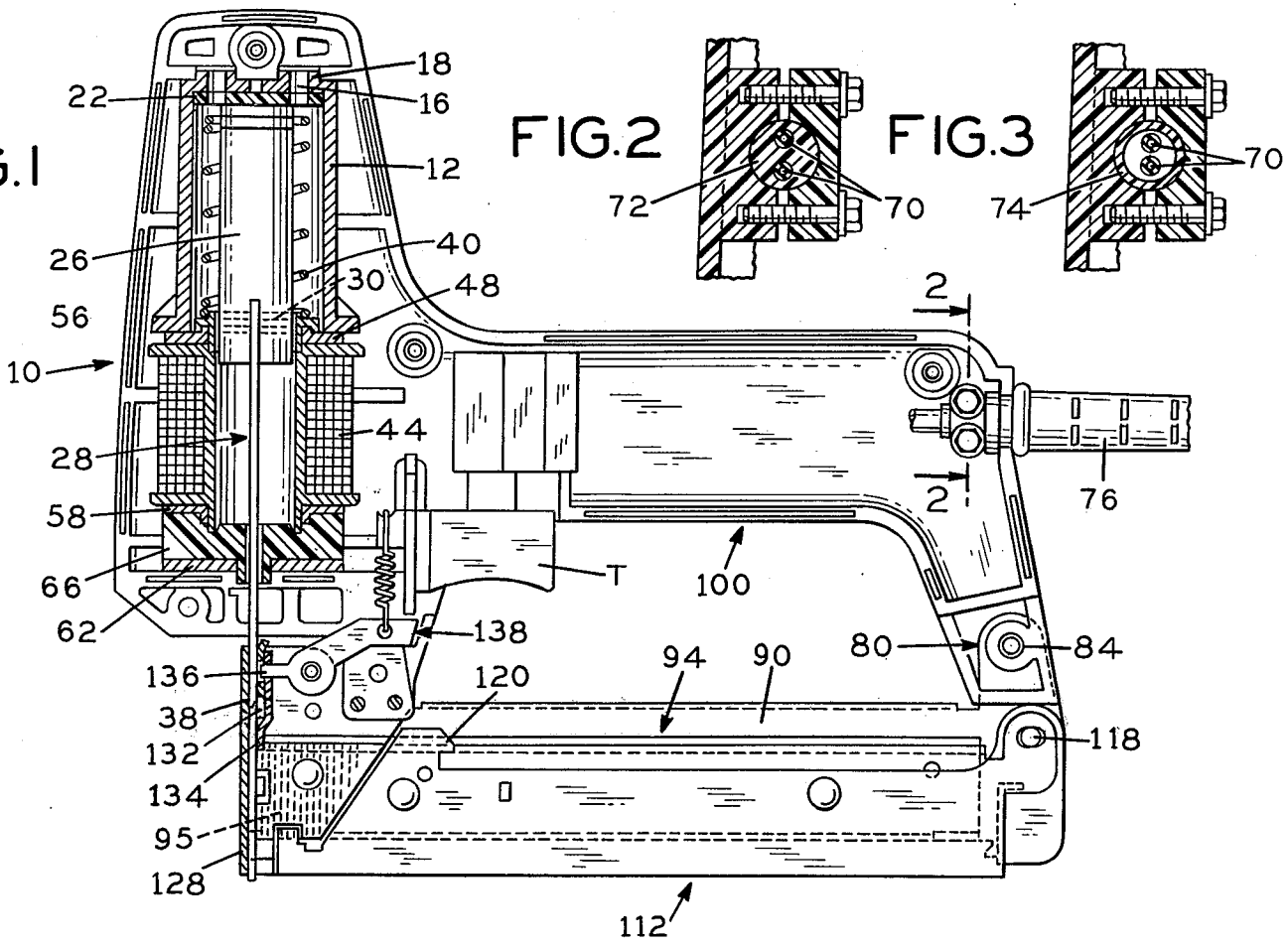
FIG. 1 is a side elevation partly in section of a nail gun in accordance with the present invention.

An assembled two-stroke nail gun is shown in FIG. 1. The components in the elongated head portion referred to generally as 10 are shown individually in perspective in the exploded view of FIG. 4. The mechanical components shown in FIG. 4 comprise the armature assembly including driver blade assembly 11 and solenoid assembly 42.

Figure 4:
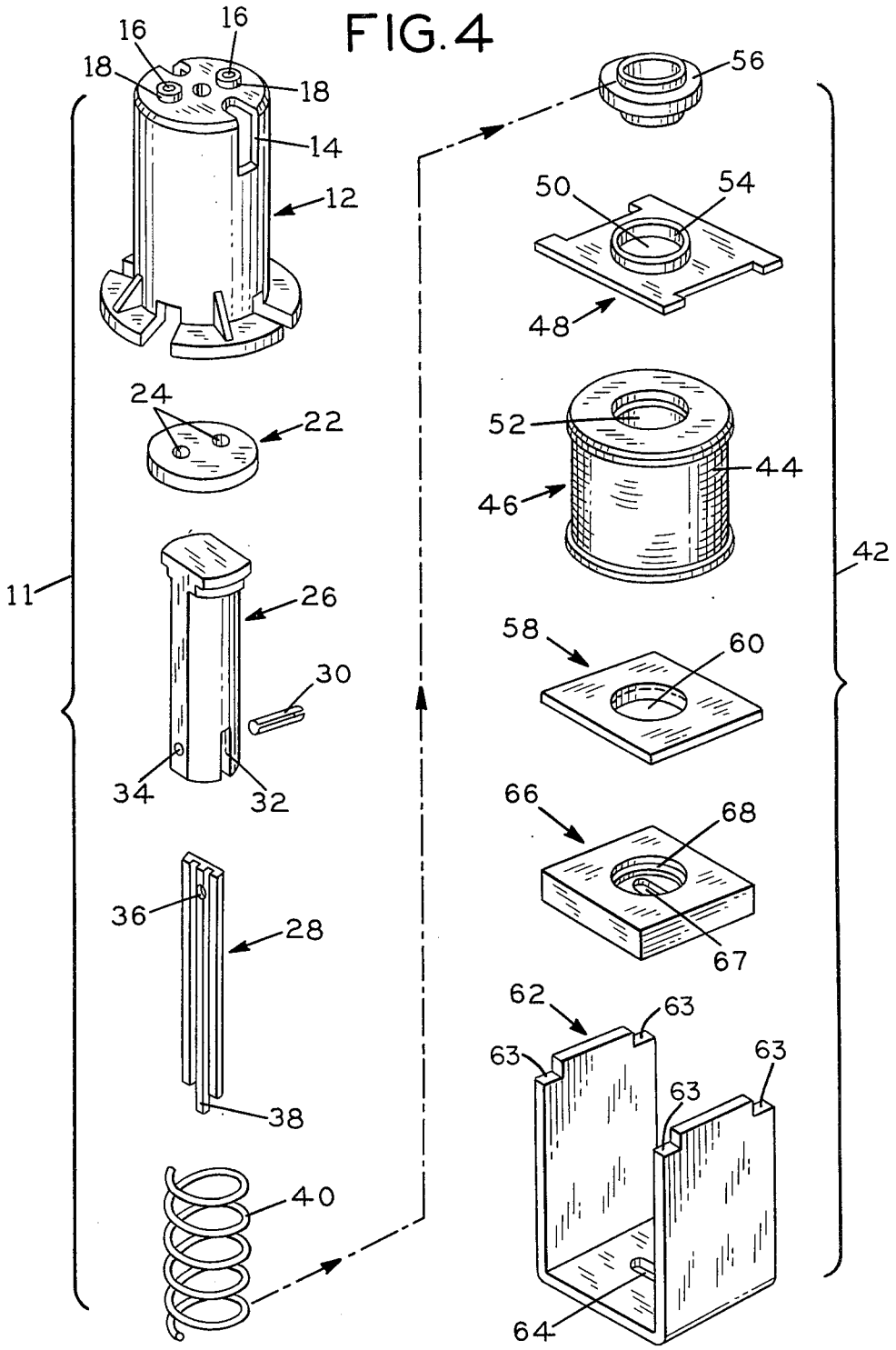
FIG. 4 is an exploded view in perspective showing the components of the armature assembly of FIG. 1.
Figure 6:
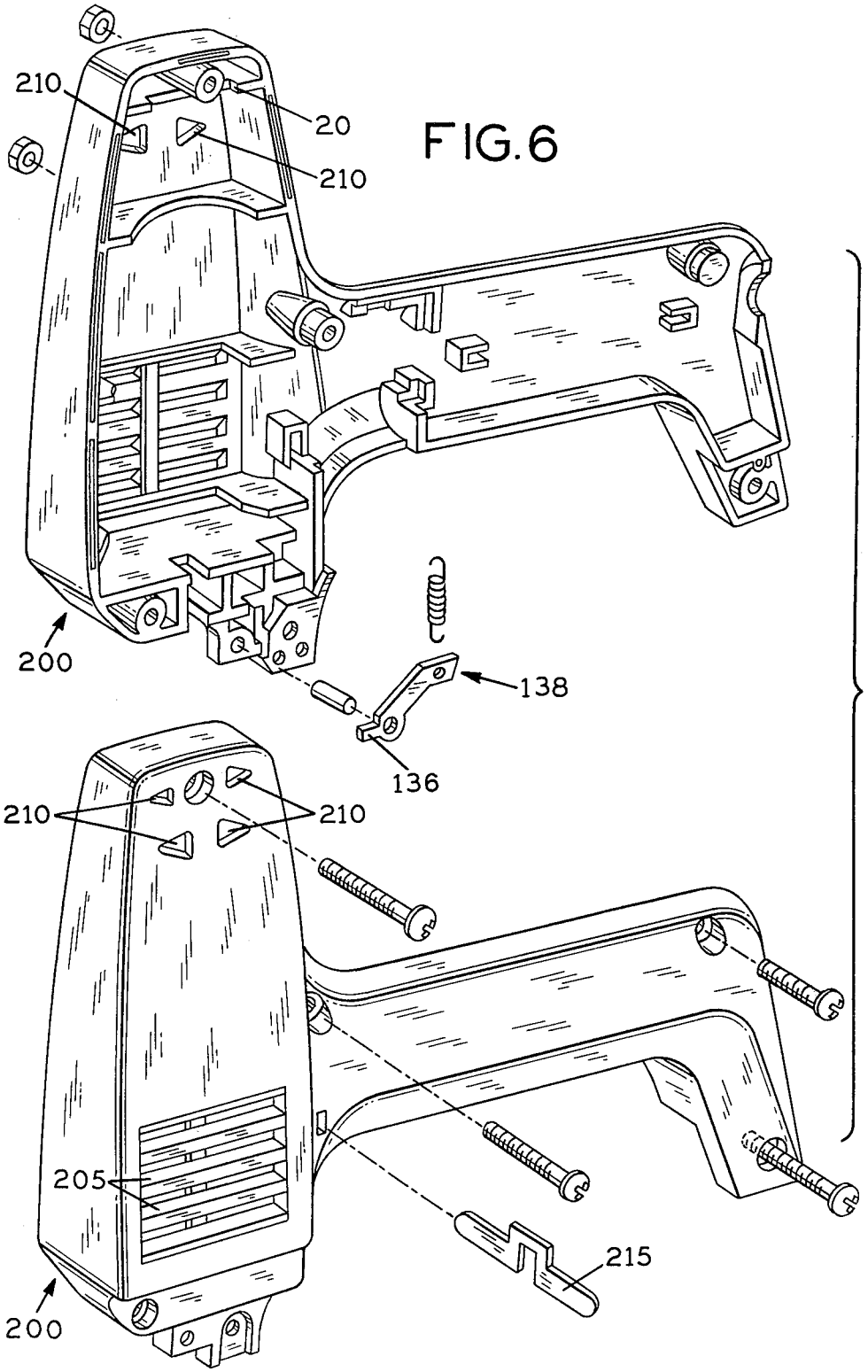
FIG. 6 is a perspective view of the outer casing of the nail gun.

The driver blade assembly 11 as shown in FIG. 4 comprises a plastic interior enclosure or cylinder 12 which is provided with a pair of enlarged vents 14 which aid in cooling the device during operation. Cylinder 12 is further provided with a pair of cylindrical ports 16 having outwardly projecting necks 18. The outwardly projecting necks 18 aid in the proper alignment of cylinder 12 by abutting against cutout 20 which is shown in FIG. 6. A deformable insulating buffer 22 is friction fitted in the underside of the top of the cylinder 12. The insulating buffer 22 is provided with a pair of ports 24 which are aligned with the cylindrical ports 16 of cylinder 12 and together therewith aid in the ventilation of the tool.

The driver blade assembly 11 further comprises a plunger 26, a channeled driver blade 28 and means for connecting the two such as pin 30. In the preferred embodiment of the driver blade assembly illustrated in FIG. 4 the plunger 26 is provided with a slot 32 which extends diametrically through lower portions thereof to permit the top end of driver blade 28 to be fitted thereinto. Plunger 26 is further provided with a hole 34 which extends through the slot 32 and which is adapted to receive the pin 30 in a direction transverse to the slot 32. Driver blade 28 includes a hole 36 which is adapted for alignment with hole 34 of plunger 26. This permits pin 30 to pass therethrough to secure driver blade 28 in slot 32 of plunger 26. At the bottom end of driver blade 28 there is provided a narrow extension 38 which strikes the head of each nail twice during a nailing operation. There is also provided a spring 40 for normally biasing the driver blade assembly in the "up" or retracted position. The connection of the driver blade to the plunger may be insulated as described hereinbelow in connection with FIGS. 7 through 11. An insulated connection is required for double insulation of the tool.

The solenoid assembly 42, illustrated in the exploded view of FIG. 4, comprises a solenoid 46 in which a winding 44 is wound about a spool which has a central opening 52. Upper end plate 48 and lower end plate 58 are configured to abut against the corresponding ends of solenoid 46. To eliminate "electrical creep", the end plates are provided with outwardly extending necks (e.g. 54) which engage deformable insulating insert or upper buffer 56 and lower deformable buffer 66. Upper buffer 56 is designed to fit between the upper end plate 48 and spring 40. Lower end plate 58 which has a central opening 60 corresponding to the central openings 50 and 52 of the upper end plate 48 and solenoid 46, respectively. The above-described components of the solenoid assembly 42 when assembled are housed in a generally U-shaped metallic casing 62 which is provided with a lateral slot 64 through the bottom thereof. Lateral slot 64 permits the driver blade 28 to extend through the solenoid assembly during a downward stroke of the tool. Casing 62 is provided with notched corners 63 which are enaged by extended portions 49 of upper end plate 48 when the tool is assembled. Upper end plate 48 has extended portions 49 at the corners thereof which engage notches in the casing 62.

To prevent excessive vibration of the tool during operation and to provide further insulation, a lower insulating deformable buffer 66 is disposed within the solenoid casing 62 adjacent slot 64. Lower buffer 66 has a circular cavity 68 which corresponds to and is aligned with central opening 60 of the lower end plate 58. Lower buffer 66 also has a lateral slot 67 extending therethrough which corresponds to and is aligned with slot 64 of the solenoid casing 62. The components described hereinabove in connection with solenoid assembly 42 provide for double insulation of the tool. If double insulation is not desired, buffers 56 and 66 as well as extension 54 of the upper end plate 48 may be eliminated.

FIG. 2 shows a pair of conductors 70 encased in a molded member 72. As an optional safety feature for this tool the conductors 70 may be individually insulated by sleeve 74 as shown in FIG. 3. Sleeve 74 is in turn encased in line cord 76.

Figure 5:
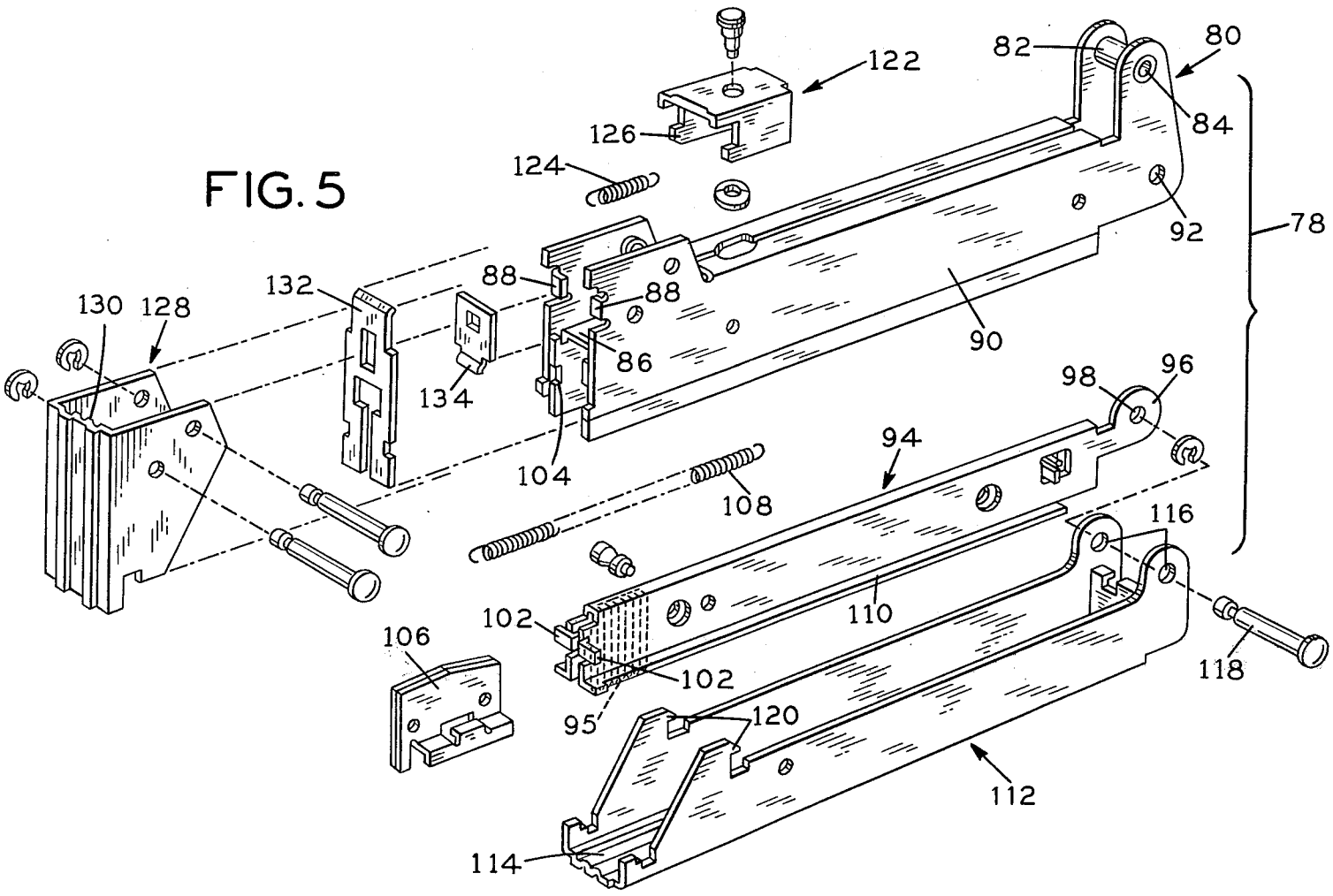
FIG. 5 is a perspective exploded view of the magazine and associated components of the nail gun of FIG. 1.

The magazine assembly 78 and related components of the lower portion of the tool is illustrated in an exploded view of FIG. 5. The magazine assembly 78 comprises an elongated magazine 80 which comprises a pair of side plates 90 which are attached to the handle portion 100 of the tool by means of spacer 82 which is supported between openings 84 at the rear end of the magazine. Each of the plates 90 also has a second opening 92 below openings 84. Inside the magazine 80 there is a channel 86 which extends lengthwise thereof. Above the channel 86 and at the forward end of the magazine there are a pair of inwardly facing tabs 88.

Below the channel 86 and between side plates 90 a nail guide 94 is situated. At the rear end of the nail guide 94 there is a generally circular connector 96 which has a centrally located hole 98 which is aligned with holes 92 of magazine 80. Nail guide 94, which is generally U-shaped, houses a strip of nails 95 which are advanced towards its front end. At the front end of the nail guide 94 there are a pair of outwardly turned tabs 102 which are aligned with cutouts 104 in side plates 90 of magazine 80. Within the U-shaped nail guide 94 there is a nail follower 106 which continuously urges the strip of nails toward the front end of the nail guide by the action of follower spring 108. The bottom of the nail guide 94 is outwardly extended as shown at 110.

The nail guide 94 together with magazine 80 fits within cover 112 which has a bottom portion 114 to support flat portions 110 of nail guide 94. At the rear end of cover 112 there are a pair of holes 116 which are aligned with hole 98 of the nail guide and holes 92 of the magazine 80. A pin 118 extends through holes 116, 92 and 98 to hingedly attached the cover to the magazine.

To maintain the cover 112 in a closed position, there is provided a latch 122. Latch 122 is made retractable by the action of spring 124. Latch 122 also has a pair of teeth 126, each of which hooks into one of the catches 120 of cover 112 to maintain the cover closed. About the forward end of magazine 80 there is a sheath 128 which includes a track 130 along which each foremost nail is driven during operation of the tool. Sheath 128 is attached to magazine 80 by means of a pair of pins 129. To permit pins 129 to connect sheath 128 to magazine 80 there is provided a pair of holes 131 for each pin 129 through sheath 128 and holes 133 through each side plate 90 of magazine 80. The sheath 128 is channeled so as to conform to the channels of the driver blade 28 to assure proper alignment of the driver blade and nail during operation of the tool.

Enclosed within the sheath 128 are a driver backing plate 132, nail clamp 134 and tang 136 of pivotable lever member 138 shown in FIG. 6. The clamping mechanism which is shown assembled in FIG. 7, operates generally as that of the clamping assembly described in application Ser. No. 880,846, filed Feb. 23, 1978, referred to hereinbelow. The clamping mechanism prevents the movement of a following nail into the driving path while the nail being driven by the driver blade receives two strokes.

The clam shell construction of the tool is illustrated in FIG. 6 with the internal components not shown except for lever member 138. To prevent overheating of the tool during repeated operation, each half clam shell 200 is provided with a plurality of upper vents 210 in the vicinity of the cylinder 12 and louvered openings 205 in the vicinity of the solenoid assembly 42. A retractable safety latch 215 is provided to prevent accidental operation of the tool.

The channeled driver blade 28 is shown in FIGS. 8 and 9. A form of driver blade 28' for use in a double insulated construction of the tool is shown in FIGS. 7 and 10. In this form, driver blade 28' is provided with an enlarged teardrop shaped head 140, preferably plastic, which is pressed into an opening in the bottom of an alternate form of plunger 26'. The driver blade 28' may also be secured to plunger 26' by a plunger cap 27 which is press fit onto plunger 26' at annular groove 27'. An underside view of the driver blade 28', teardrop shaped cap 140, plunger cap 27 and plunger 26' is shown in FIG. 11.

II. Electronic Circuitry

Figures 12, 12A:
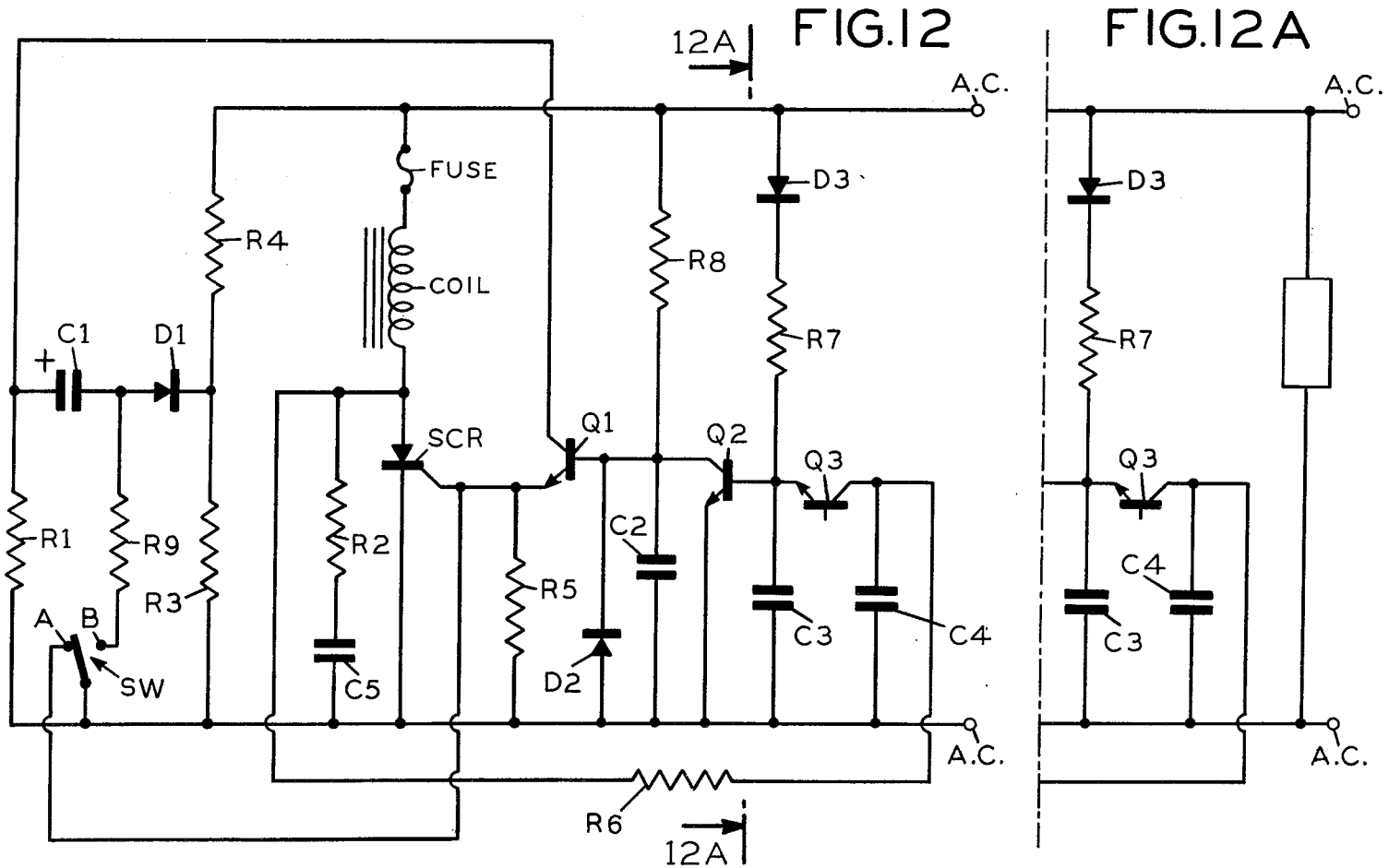
FIG. 12 is a schematic circuit diagram of an electronic pulsing circuit which provides two strokes for each activation of the trigger and which may be operated either in a 110 V. or 220 V. operational mode.
FIG. 12A is a modification of a portion of the schematic diagram shown in FIG. 12 in which an additional circuit component has been added across the AC line as a safety feature for use in either 110 V. or 220 V. operational mode.

The circuits shown in FIGS. 12 and 12A are alternative circuits which assure that the electric stapler provides two strokes to a fastener for each actuation of the trigger T shown in FIG. 1. The circuit may be used in either a 110 V. or 220 V. operational mode depending on the values of the circuit components selected as set forth herein.

As shown in FIG. 12, capacitor C1 stores the power which is used to drive the gate of the SCR. C1 is charged when switch SW is open (indicated by position A) by way of the voltage divider of R4 and R3, the rectifier D1 and R1 to about 35 V.

$$\left(\frac{R3}{R3 + R4} \times \text{Peak AC line voltage}\right).$$

When switch Sw is closed (indicated by position B) this voltage is made available to the collector of Q1 and further charged of C1 is prevented by the low resistance path between switch SW and capacitor C1 through resistor R9.

Q1, Q2 and their associated base RC's provide for turning on Q1 (and therefore the SCR is SW is closed) for several tenths of a millisecond immediately following each positive-going zero-crossing of the AC line. Transistors Q1 and Q2 are each protected by a diode, D2 and D3, respectively.

The RC circuit which drives the base of Q1 is an order of magnitude faster than the RC circuit which drives the base of Q2. When Q2 turns on it clamps the base of Q1 turning off Q1. Q1 is therefore only on for the short time provided by the difference between the R8C2 time constant and the R7C3 time constant. The result is that if switch SW is closed and C1 is charged, Q1 will drive a pulse into the gate of the SCR and turn it on immediately following each positive zero crossing of the AC line.

Capacitor C1 stores enough power to allow Q1 to pulse on the SCR for a number of consecutive positive half-cycles. The amount of charge removed from C1 each time Q1 turns on the SCR would be relatively small because Q1 only stays on for a short time if not for the action of transistor Q3 which will be discussed in detail below.

In order to prevent the SCR from firing for more than two consecutive positive half-cycles, it is necessary to discharge C1 before the third positive half-cycle can occur. In order to prevent flase firings of the SCR from low voltage spikes, there is provided an RC snubber circuit, comprising resistor R2 and capacitor C5 placed across the SCR.

C4 and R6 "see" the AC line voltage when the SCR is off. C4 has a 3.3 V. peak sine wave across it 90° behind the line voltage. When the SCR tuns on, the positive half of the AC line is excluded from C4 and R6. At the time the SCR turns on, C4 has a −3.3 V. across it. During the first negative half-cycle after the SCR had turned on, C4 charges to −9.9 V.

Q3 is used in its reverse breakdown mode. That is, its gate is clipped so that its operation is akin to a Zener diode. Q3 conducts only when the voltage across it, collector to emitter, exceeds about 6.6 V. (at about 1 μa).

When Q3 conducts it holds the base of Q2 out of conduction much longer than the time constant of R7 and C3 normally allow. With Q2 held *off* longer than normal, Q1 stays *on* longer after the positive zero crossing of the AC. This extra *on* time for Q1 allows it to thoroughly discharge C1 and limits the circuit to delivering only *two* consecutive positive half line cycles to the stapler coil.

The circuit recovers for its next two-shot firing when the switch is released and C1 can be recharged. At the same time C1 is charging, C4 is discharging its DC voltage through R6 since it now "sees" only an AC voltage. A 12 V. AC circuit requires about ⅓ second to recover before its next two-shot cycle. If the circuit is asked to fire before its ⅓ second recovery time has elapsed, it may produce a one-shot instead of two-shot firing.

A list of components for a 110 V. AC 60 Hz circuit is shown in Table 1.

TABLE 1

| Component | Value |
|---|---|
| R-1 | 100 K Ω |
| R-2 | 470 Ω |
| R-3 | 27 K Ω |
| R-4 | 100 K Ω |
| R-5 | 1,000 Ω |
| R-6 | 560 K Ω |
| R-7 | 1,000 K Ω |
| R-8 | 100 K Ω |
| C-1 | 1 μf |
| C-2 | .001 μf |
| C-3 | .001 μf |
| C-4 | .15 μf |
| C-5 | .047 μf |

D1 is a 75 V., 5 MA silicon diode (i.e., IN914, IN914A).

D2 is a 400 V., 3A silicon diode (i.e., Motorola MR 504).

Q1 and Q2 are: NPN, Silicon, Vceo 40; hfe 50 to 300 IC Max.=200 MA (i.e., 2N3904 or equivalent).

SCR is a 200 PRV, 8 Amp SCR with a gate turn on current Igt Max.=25 MA for 120 V. applications.

Q3 is a signal type silicon transistor with a reverse breaddown voltage $Vceo_r$=6.6%±20% @ 1 μa. and a maximum dissipation of 25 mw.

In the 220 V. AC 60 Hz circuit the values of the circuit components are the same as those for the components listed in Table 1 except as shown in Table 2 below.

TABLE 2

| Component | Value |
|---|---|
| R-4 | 220 K Ω |
| R-6 | 1,200 K Ω |
| R-7 | 2,200 K Ω |
| R-8 | 220 K Ω |

When used in a 220 V. circuit the SCR becomes a 400 PRV, 15 Amp, max. gate current=25 mz.

In the 220 V. circuit, the SCR must be protected from having its maximum peak reverse voltage and breakover voltage ratings exceeded by a power line transient. This requires a varistor or a capacitor directly across the line as shown by the box in FIG. 12A to limit the peak line voltage. A 0.1 μf capacitor will protect against a 3A-10 μsec or a 10A-3 μsec power line transient coinciding with line-voltage peak and an absolute SCR rating of 600 volts. A varistor provides greater protection and is preferred over a line-capacitor.

Although the above circuits have been shown and described as discrete circuits, they can, of course, also be in the form of integrated circuitry.

We claim:

1. An electrically operated portable nail gun comprising:

(a) a hollow body of clam shell construction including an elongated head portion housing an armature assembly which includes:
  (i) a solenoid,
  (ii) a plunger which fits within and slides axially of said solenoid in response to actuation of the tool, and
  (iii) a channeled driver blade electrically insulatingly connected to said plunger, said blade having a plurality of longitudinal channels therein;

(b) a handle portion projecting rearwardly from said head portion having a trigger for actuating the tool; (c) a magazine connected to said handle portion for holding a plurality of nails and for advancing said nails into position to be driven by said driver blade;

(d) a sheath connected to the forward portion of the magazine, said sheath being configured for driving alignment and sliding engagement with the plurality of channels of said channeled driver blade;

(e) an electronic trigger control circuit responsive to said trigger which supplies the solenoid with two unidirectional current pulses for impelling the driver blade to provide two successive driving strokes in response to each actuation of the trigger;

(f) means for preventing more than one nail from being driven during a single actuation of the tool by preventing the advancement of a second nail into the axial path of the driver blade while a first nail is being driven; and (g) upper and lower solenoid end plates each of which includes an outwardly extending neck about an opening therethrough, and an upper and a lower insulating buffer each of which is configured for mating engagement with the neck of a corresponding end plate.

2. The nail gun according to claim 1 which further comprises means for electrically insulating the driver blade from the plunger.

3. The nail gun according to claim 2 which further comprises means for electrically insulating the solenoid.

4. The nail gun according to claim 1 wherein said magazine assembly comprises:

(a) a magazine attached to said handle portion;

(b) a nail guide for housing a strip of nails which fits within the magazine;

(c) a nail guide follower which fits within the nail guide and urges the nails therein into the driving position; and (d) a loading cover hingedly connected to the magazine for retaining the nail guide within said magazine.

5. The nail gun according to claim 1 wherein said electronic trigger control circuit includes:

(a) unidirectional controlled conduction means for rectifying alternating current comprising at least three terminals including a gate;

(b) first circuit means connecting said solenoid and said controlled conduction means in series with said source of alternating current;

(c) switch means operable at random times relative to the cycles of said alternating curent;

(d) second circuit means controlled by said switch means for supplying current to said gate to place said controlled conduction means in a conductive state during a properly poled half-cycle of said alternating current upon actuation of said switch means;

(e) third circuit means for providing sufficient holding current to the controlled conduction means to enable the controlled conduction means to conduct during two successive like-poled half-cycles of said alternating current; and (f) fourth circuit means for draining sufficient current during the first two successive like-poled half-cycles of said alternating current to assure that no more than two successive current pulses are transmitted to the solenoid during a single actuation of the tool.

6. The trigger control circuit of claim 5 in which said unidirectional controlled conduction means is an SCR.

7. The trigger control circuit of claim 6 wherein said fourth circuit means comprises a plurality of transistors and an RC circuit of specified time constant associated with each transistor.

8. The trigger control circuit of claim 7 which further comprises means for preventing the maximum peak reverse voltage and breakover voltage of the SCR from being exceeded by a power line transient.

9. The trigger control circuit of claim 8 wherein a varistor is placed across the AC line.

10. The trigger control circuit of claim 8 wherein a capacitor is placed across the AC line.

11. The nail gun according to claim 1 wherein said electronic trigger control circuit is operated by a 110 V. AC source.

12. The nail gun according to claim 1 wherein said electronic trigger control circuit is operated by a 220 V. AC source.

* * * * *